US008839546B2

(12) United States Patent
Taylor

(10) Patent No.: US 8,839,546 B2
(45) Date of Patent: Sep. 23, 2014

(54) BARREL CLIP FOR FIREARM SUPPORT

(76) Inventor: Jack Ray Taylor, Prescott, AZ (US)

( * ) Notice: Subject to any disclaimer, the term of this patent is extended or adjusted under 35 U.S.C. 154(b) by 99 days.

(21) Appl. No.: 13/065,706

(22) Filed: Mar. 29, 2011

(65) Prior Publication Data

US 2012/0246990 A1 Oct. 4, 2012

(51) Int. Cl.
*F41C 23/00* (2006.01)
*F41C 33/00* (2006.01)

(52) U.S. Cl.
CPC ..... *F41C 33/007* (2013.01)
USPC ..... 42/85; 42/107

(58) Field of Classification Search
USPC ..... 42/85, 107
See application file for complete search history.

(56) References Cited

U.S. PATENT DOCUMENTS

| | | | | |
|---|---|---|---|---|
| 409,239 | A | 8/1889 | Roller | |
| 897,577 | A * | 9/1908 | Bourne | 42/59 |
| 3,022,898 | A | 2/1962 | Loeb | |
| 4,299,343 | A * | 11/1981 | Atchisson | 224/149 |
| 4,431,122 | A * | 2/1984 | Garmong | 224/268 |
| 4,542,840 | A | 9/1985 | Pepper, Sr. et al. | |
| 5,205,523 | A | 4/1993 | Jones | |
| 5,332,090 | A * | 7/1994 | Tucker | 206/315.3 |
| D375,453 | S | 11/1996 | Fleck | |
| D378,954 | S | 4/1997 | Daigle | |
| RE37,111 | E | 3/2001 | Barron | |
| 6,272,785 | B1 | 8/2001 | Mika et al. | |
| 6,634,528 | B2 | 10/2003 | Hurtgam | |
| 6,808,095 | B2 | 10/2004 | Hurtgam | |
| 6,951,072 | B2 * | 10/2005 | Schurtenberger | 42/94 |
| 7,104,262 | B2 * | 9/2006 | Yorns et al. | 124/10 |
| D560,482 | S | 1/2008 | Casteel et al. | |
| 7,380,486 | B1 * | 6/2008 | Bean | 89/37.04 |
| 2003/0000123 | A1 * | 1/2003 | Phillips et al. | 42/85 |

* cited by examiner

*Primary Examiner* — Samir Abdosh
(74) *Attorney, Agent, or Firm* — J. Adele Plotkin

(57) ABSTRACT

A barrel clip of unitary plastic construction is used to securely clip onto the barrel of a firearm and simultaneously is able to hook the firearm to a non-human support such as a fence when, during hiking and/or hunting, there is a need for the hiker and/or hunter to be hands free and out of contact with his/her firearm. This lightweight, inexpensive inventive barrel clip helps prevent clogging and dirtying of the firearm barrel. Further it does not cause damage to the environment in which it is used. It is easily stored in a pocket, on the barrel of the firearm, or clipped onto some convenient item being taken on the hike and/or hunt.

19 Claims, 2 Drawing Sheets

BARREL CLIP FOR FIREARM SUPPORT

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A SEQUENCE LISTING, A TABLE, OR A COMPUTER PROGRAM LISTING COMPACT DISC APPENDIX

Not applicable

BACKGROUND OF THE INVENTION

Hunting is an enjoyable activity for many Americans and other people around the world. They take their firearms and hike out to the hunting grounds. Along the way they may need to traverse fences such as rural western ranch fences or T post fences. There may also be other obstacles to traverse along the way. At times the hunters will need to find a reasonable location to relieve themselves. Hence there are multiple reasons why people may need to free up their hands and temporarily not carry their firearms or other weapons such as archery bows and arrows.

Usually when this occurs, the firearms are leaned [without being secured] against a tree or other support. If another hunter is present, the firearms might be given to the other hunter to hold. Alternatively they are placed on the ground. Debris, mud, water, snow, etc. can then dirty the firearm or its barrel This inventor has noted that over the last 30 years or so, neither the trade literature nor hunting practices have adequately addressed the need for more securely stowing firearms when hands-free and firearm-free needs arise. Hence there remains a need for better firearm management in these situations to prevent dirtying or damaging the firearm that must be temporarily put aside.

The present invention uses a barrel clip of unitary construction without springs or brackets to attach a firearm to a fence, tree branches, or other available non-human supports in order to free up the hunter's hands for other activities.

A variety of clips exist in the non-firearm related areas. Examples include ornamental clips such as the handle clip of D560482 and the Christmas Light Holder of D375453. Another example is seen in U.S. Pat. No. 5,332,090 in which Tucker describes a golf putter holder as a lightweight molded holder that hooks onto and grips the rim of a golf bag and holds a golf putter in an upright position. The Tucker holder configuration is different than that of the present invention. Further there is no suggestion by Tucker that his holder can be used for anything other than golf clubs.

Similar belt and bag holders, also including a deflecting tab slot and used for golf accessories, are described in Hurtgam's patents: U.S. Pat. Nos. 6,808,095 and 6,634,528. Again the configuration is different than that of the present inventive clip and no suggestion is made to use such holders outside of the needs in golfing. Further, the holders may be attached to belts on people. This would not occur with use of the present inventive clip/barrel combination as the need is to provide a temporary support away from the people.

It is well known that there are clips that attach firearms to slings or belts worn by their bearers. Examples of such clips include U.S. Pat. Nos. 4,431,122, 4,542,840, Re37111, and D378954. However none of these are configured as is the present invention. Further, none of these clips are intended for use in attaching firearms to fences, tree branches, or other non-human supports.

In U.S. Pat. No. 897,577, Bourne describes a barrel grip for pistols that allows for more accurate shooting when the shooter rests the flattened part of the grip extension on a support surface . The construction is not unitary and is not for stowing the pistol temporarily away from the shooter.

There are also clips known that attach firearms to non-moving supports in order to enable better shooting or to free up the hunter's hands. Such supports may be tripods, tree trunks, etc. Examples of such clips include U.S. Pat. Nos. 3,022,898, 6,272,785, 6,951,072, and 7,380,486. These clips are not of unitary construction and are of very different configurations as compared to the present inventive barrel clip.

For instance, Schurtenberger in U.S. Pat. No. 6,951,072 describes a barrel mounted foldout gunrest hook. The attachment to a barrel includes a barrel attaching bracket of a split ring with a screw for size adjustment. A sharp hook is extended from the bracket and used to pierce wooden materials in order to secure the firearm to the wood for steadier shooting. Not only is this device's configuration not unitary, but also use of this device causes damage to the wooden environment it is used on.

Clearly there therefore is a need for a barrel clip of unitary, simple, inexpensive, lightweight construction that can be easily, rapidly, and reversibly used to safely hook firearms or other weapons onto fences, tree branches, or other objects during hiking without damaging the firearms or other weapons nor the environs.

BRIEF DESCRIPTION OF THE INVENTION

The present invention uses an accessory barrel clip of unitary construction without springs or brackets to attach a firearm such as a rifle, shotgun, etc., to a fence, tree branches, or other available non-human supports in order to free up the hunter's hands for other activities. When not in use, this lightweight, small, barrel clip may be conveniently carried in a pocket, clipped on a belt or other article of clothing, or it may be left on the barrel of the firearm.

The barrel clip is composed of a holder clip portion that fits around a firearm barrel and a support clip portion that allows for temporary attachment to a support for interim storage of the firearm. The holder clip portion is flexible enough to open the barrel gripping section adequately in order to engage the barrel and then close enough to grip it securely. The clip may be molded to match up with considerably different barrel shapes and sizes as may be present in various types of firearms or even other types of weapons.

The holder clip body is a generally tubular shape with a gap opening on one side. The edges of the opening may be flared to enable easier removal of the clip from a firearm barrel. On the other side of the tubular construct, opposite the gap opening, is a non-piercing support clip that can hook over a portion of a fence or other support.

The present inventive barrel clip meets the need to provide secure support for a firearm to allow a hunter to participate in an activity that requires hands-free and firearm-free status yet is inexpensive to construct , lightweight, and easy to use rapidly.

Such support is accomplished by use of this inventive barrel clip according to these steps:

a) obtaining a barrel clip comprising a holder clip portion and a support clip portion,
b) attaching the holder clip portion to the barrel of said firearm,
c) attaching the support clip portion to the support structure,
d) maintaining the attachment to the support structure for as long as is needed,
e) detaching the support clip portion from the support structure when the attachment is no longer needed.

Further, the barrel clip is of integral unitary construction and therefore contains no brackets, springs, screws, etc.

Additionally, the barrel clip is of a plastic material that allows adequate flexibility for ease of attachment to the barrel of a firearm and also sufficient rigidity to securely hold the barrel without slipping.

Use of the inventive barrel clip when attached to a barrel and holding the firearm in an upright position away from contact with the hunter helps keep the firearm clean and free from clogging or dirtying with mud, debris, water, snow, etc. Hence this inventive barrel clip, when used correctly, considerably reduces or totally prevents damage to the firearm being temporarily supported as described above.

Further, use of this inventive barrel clip does not damage the environment.

DETAILED DESCRIPTION OF THE INVENTION

The present invention focuses on a barrel clip for use with the barrel of a firearm in order to provide support by attachment to an appropriate support structure available during a hike and/or hunt when the hunter must be free of the firearm in order to tend to some other task; on the way the barrel clip is used; and on the firearm in combination with the inventive barrel clip both in supported and in unsupported conditions. The barrel clip is of a one piece, unitary construction without attachments such as springs, screws, or brackets or any similar attachments and without any apertures for use with any such attachments. The inventive barrel clip is used to attach a firearm to a fence, tree branches, or other available non-human supports in order to free up the hunter's hands for other activities. When not in use, this lightweight, small, barrel clip may be conveniently carried in a pocket, clipped on a belt or other article of clothing, or it may be left on the barrel of the firearm. The various means to mold such an integral unitary construction are well known in the molding art.

Figure 1:
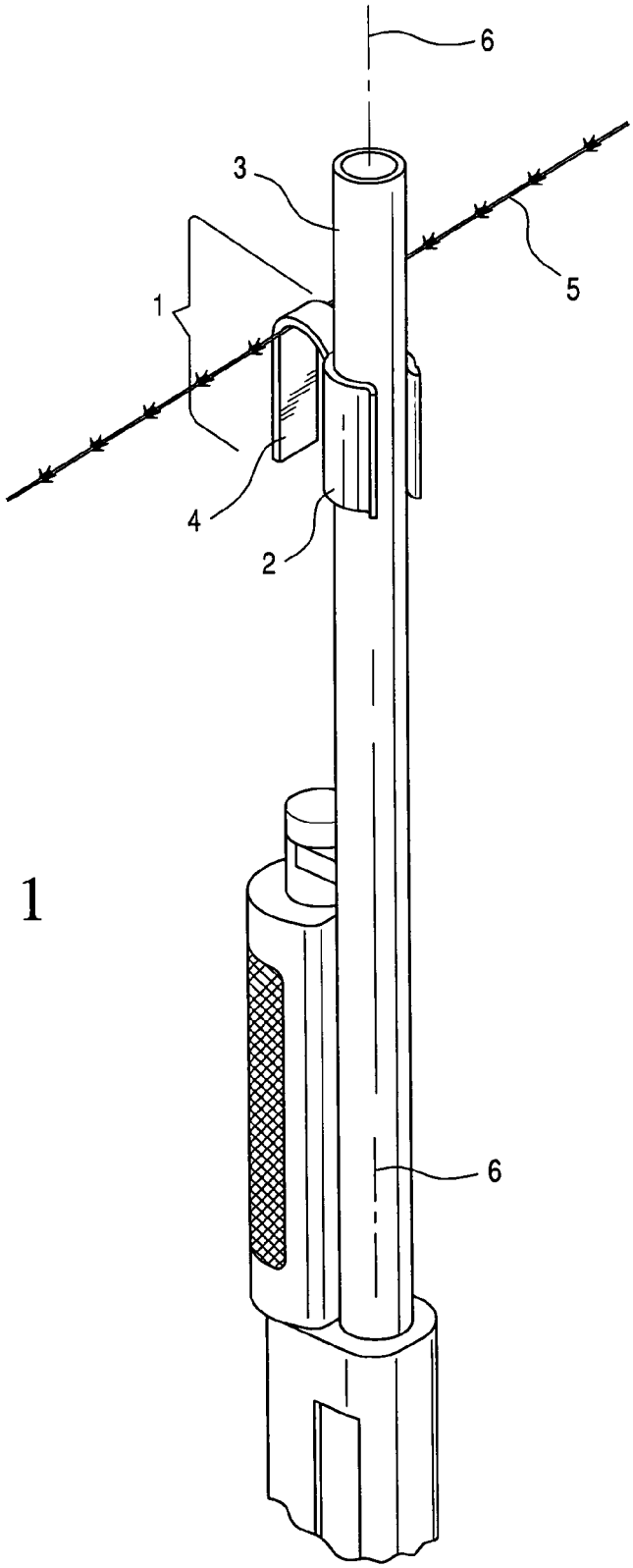
FIG. 1 depicts the combination of the inventive barrel clip on the barrel of a firearm and supported by a support structure.

As seen in the embodiment of the present inventive barrel clip depicted in FIG. 1, in general, the present inventive barrel clip (1) is composed of a holder clip portion (2) that fits around a firearm barrel (3) and a support clip portion (4) that allows for temporary attachment to a support structure (5), such as a fence, for temporary storage of the firearm. The holder clip portion is flexible enough to open the barrel gripping section adequately in order to engage the barrel but still adequately rigid to then close enough to grip the barrel securely. Accordingly, the clip may be molded to match up with considerably different barrel shapes and sizes as may be present in various types of firearms, each being a different embodiment of the present inventive barrel clip.

Support using this inventive barrel clip is accomplished according to these steps:

a) obtaining a barrel clip comprising a holder clip portion and a support clip portion,
b) attaching the holder clip portion to the barrel of a firearm,
c) attaching the support clip portion to the support structure,
d) maintaining the attachment to the support structure for as long as is needed,
e) detaching the support clip portion from the support structure when the attachment is no longer needed.

Figure 2:
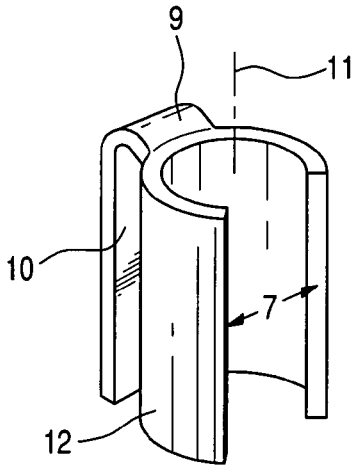
FIG. 2 provides a more detailed view of one embodiment of the inventive barrel clip of unitary plastic construction without attachments such as springs, screws, or brackets or any similar attachments and without any apertures for use with said attachments.

A closer view of an embodiment of the barrel clip is seen in FIG. 2. The holder clip body (12) is of a generally tubular shape with a gap opening (7) on one side. The central axis (11) of the tubular portion is intended to align with the central axis of a firearm barrel (FIG. 1, #6).

On the outside of the other side of the tubular construct, opposite the gap opening, is a non-piercing support clip (9) that can hook over a portion of a fence or other support. The support clip contains a hook section (10) extending from the tubular section in a direction that approximately parallels the central axis (11) of the tubular body (12). The support clip is flexible enough to allow entry of the desired portion of a support to within the space defined by the hook section (10) and the adjacent external side of the tubular body (12). When the support clip hooks over the desired portion of the support structure in a vertical, downward motion, gravity helps to maintain the position of the firearm on the support.

Figure 3:
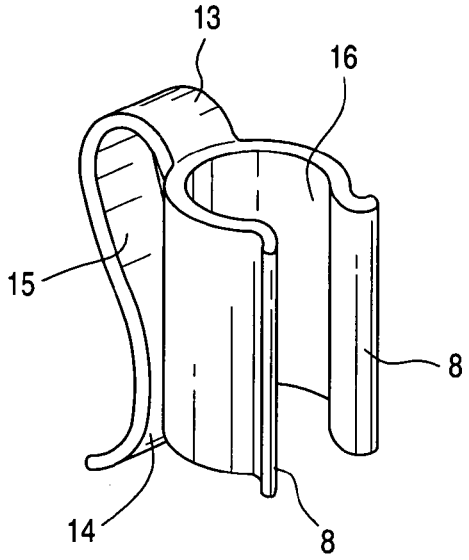
FIG. 3 depicts a second embodiment of the inventive barrel clip, also a barrel clip of unitary plastic construction without attachments such as springs, screws, or brackets or any similar attachments and without any apertures for use with any said attachments.

In another embodiment as seen in FIG. 3, the support clip (13) can also have a means to grip a support structure by having the unattached, distal end (14) of the hook section (15) bend in towards the tubular body (16). The edges (8) of the gap opening may be flared to enable easier removal of the barrel clip from a firearm barrel.

Figure 4:
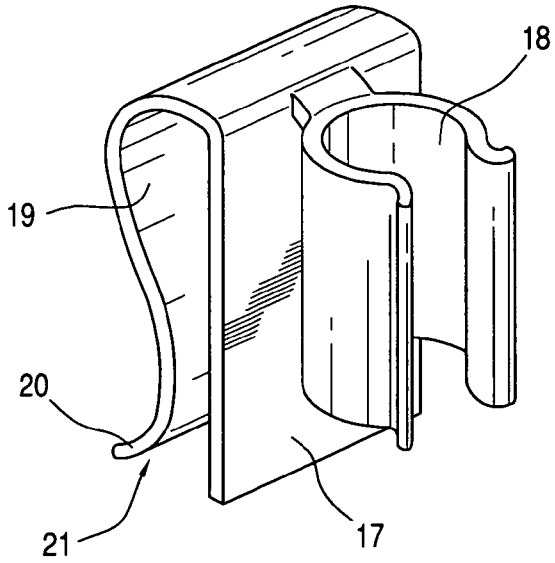
FIG. 4 depicts a third embodiment of the inventive barrel clip, again a barrel clip of unitary plastic construction without attachments such as springs, screws, or brackets or any similar attachments and without any apertures form use with any said attachments.

Alternatively, as seen in FIG. 4, there can also be a straight leg section (17) attached to the tubular body (18) between the tubular body and the hook section (19). This leg section can extend parallel to the central axis of the tubular body to a distance beyond the unattached end of the hook section. This provides a solid flat surface to press against the support structure on one side and the unattached end of the hook section to press against the support structure from the other side thereby gripping the support structure. A flare (20) to the outside on the unattached end (21) of the hook section (19) allows for easier removal of the support clip when support is no longer needed.

Clearly such a flare could be added to embodiments that do not have a flared end to the hook section. Various other modifications may be included as are obvious to those skilled in the art. All such modifications would therefore be within the scope of this present invention and covered by the claims appended herewith.

That which is claimed is:

1. A barrel clip used to temporarily attach a firearm comprising a barrel of a given length to a support structure by a hunter or a hiker in need of being with hands free and without contact to said firearm comprising c) A holder clip portion to reversibly engage and grip said barrel and d) A support clip portion to temporarily attach said barrel gripped by said holder clip portion to said support structure by a hooking motion wherein said barrel clip is of unitary plastic construction without attachments such as springs, screws, brackets or similar attachments and without any apertures for use with any said attachments and wherein said holder clip portion comprises a generally tubular shaped body with a gap opening and wherein said holder clip portion presents a generally U shaped profile.

2. The combination of a barrel clip as described in claim 1 and the barrel of a firearm wherein said barrel clip is reversibly attached to said barrel of said firearm and wherein said support clip portion is used to temporarily attach said combination to said support structure as needed during the process of hiking, hunting, or both hiking and hunting in order to provide a time for the hiker or hunter to be free of carrying said firearm and in a manner that minimizes damage from use of said combination to both said firearm and the environment.

3. A barrel clip as described in claim 1 comprising a holder clip portion and a support clip portion used to temporarily attach the barrel of a firearm to a support structure, by a hunter or a hiker in need of being with hands free and without contact to said firearm, by a process comprising a) obtaining said barrel clip, b) attaching said holder clip portion to said barrel of said firearm, c) attaching said support clip portion to said support structure, d) maintaining the attachment to said support structure for as long as is needed, e) detaching said support clip portion from said support structure when said attachment to said support structure is no longer needed.

4. The combination of claim 2 wherein said support clip portion is non-piercing.

5. The barrel clip of claim 3 wherein use of said barrel clip minimizes damage by said use to both said firearm and the environment.

6. The barrel clip of claim 1 wherein use of said barrel clip minimizes damage by said use to both said firearm and the environment.

7. The barrel clip of claim 3 wherein use of said barrel clip totally prevents damage by said use to both said firearm and the environment.

8. The barrel clip of claim 1 wherein use of said barrel clip totally prevents damage by said use to both said firearm and the environment.

9. The barrel clip of claim 1 wherein said gap opening comprises two sides with two edges, one edge per side.

10. The barrel clip of claim 9 wherein said edges are flared outwards from said tubular shaped body.

11. The barrel clip of claim 1 wherein said support clip portion is non-piercing.

12. The barrel clip of claim 1 wherein said support clip portion comprises a hook section.

13. The barrel clip of claim 12 wherein said holder clip portion comprises a generally tubular shaped body with a central axis that will parallel said length of said barrel of said firearm when said tubular shaped body is attached to said barrel and wherein said hook section approximately parallels said central axis.

14. The barrel clip of claim 12 wherein said holder clip portion comprises a generally tubular shaped body and wherein said hook section comprises an unattached end that bends in towards said tubular shaped body.

15. The barrel clip of claim 1 wherein said holder clip portion comprises a generally tubular shaped body and wherein said support clip portion comprises a hook section, an unattached end on said hook section, and a straight leg section attached to said tubular shaped body and located between said tubular shaped body and said hook section.

16. A barrel clip of claim 1 wherein said holder clip portion comprises a barrel gripping section and wherein said holder clip portion is flexible enough to open said barrel gripping section adequately in order to engage said barrel but still adequately rigid to then close enough to grip said barrel securely.

17. A barrel clip of claim 14 wherein said hook section comprises a distal portion towards said unattached end, wherein said distal portion bends in towards said tubular shaped body, and wherein said unattached end flares slightly outward away from said tubular shaped body.

18. A barrel clip as described in claim 9 wherein said support clip portion is located attached to said tubular shaped body in a position opposite to the location of said gap opening.

19. The combination as described in claim 2 wherein use of said means to hook is done in a manner that totally prevents damage from use of said combination to both said firearm and said environment.

* * * * *